United States Patent [19]

Schrank

[11] Patent Number: 4,547,702

[45] Date of Patent: Oct. 15, 1985

[54] THIN FILM ELECTROLUMINSCENT DISPLAY DEVICE

[75] Inventor: Martin P. Schrank, Ipswich, Mass.

[73] Assignee: GTE Products Corporation, Stamford, Conn.

[21] Appl. No.: 540,222

[22] Filed: Oct. 11, 1983

[51] Int. Cl.[4] ..... H05B 33/22

[52] U.S. Cl. ..... 313/509

[58] Field of Search ..... 313/509

[56] References Cited

U.S. PATENT DOCUMENTS

| | | | |
|---|---|---|---|
| 4,027,192 | 5/1977 | Hanak | 313/498 |
| 4,326,007 | 4/1982 | Williams et al. | 313/509 X |
| 4,369,393 | 1/1983 | Frame | 313/509 X |
| 4,455,506 | 6/1984 | Ayyagari et al. | 313/509 X |

OTHER PUBLICATIONS

"Electroluminescence in ZnS: $Mn_x$: $Cu_y$ rf-Sputtered Films", by J. J. Hanak, *Japanese Journal of Applied Physics*, Suppl. 2, Pt. 1, pp. 809–812, 1974.

*Primary Examiner*—Palmer C. DeMeo

*Attorney, Agent, or Firm*—Edward J. Coleman; Jose W. Jimenez

[57] ABSTRACT

An improved dark field material for use in a thin film electroluminescent display device that typically includes a transparent electrode layer, a segmented electrode layer and an electroluminescent phosphor layer between the electrode layers. The improved dark field layer is of a composition of a dielectric material such as the preferred magnesium oxide and a noble metal, which is preferably gold co-evaporated by way of an electron beam deposition technique. The preferred range of noble metal by volume is 6%-10%. By varying the noble metal content within this range, there is provided control of the operating temperature of the electroluminescent display device.

11 Claims, 2 Drawing Figures

THIN FILM ELECTROLUMINSCENT DISPLAY DEVICE

BACKGROUND OF THE INVENTION

The present invention relates in general to a thin film electroluminescent display device and is concerned, more particularly, with an improved dark field material for such a thin film electroluminescent display device.

Electroluminescent devices generally comprise a phosphor layer disposed between two electrode layers with one of the electrodes being transparent so as to permit viewability of the phosphor layer. It is known to provide a dark field layer behind the phosphor layer in order to improve the contrast ratio of the device when using a segmented back electrode layer; that is to say, to provide visibility of the phosphor layer overlying the back electrode segments even under ambient conditions of high brightness. See U.S. Pat. No. 3,560,784 for an example of a dark field layer, the material of which may comprise arsenic sulphide, arsenic selenide, arsenic sulfoselenide or mixtures thereof. However, these arsenic compounds either do not provide a satisfactory dark color or they change color during use.

Perhaps the most common dark field material presently being used is cadmium telluride (CdTe). Although the CdTe layer provides for enhancement in contrast between the displayed information and the background, one of the problems associated with the CdTe composition is that it is toxic and the material does not meet safety specifications for commercial products as required by OSHA (Occupational Safety and Health Act).

One solution to this toxicity problem is described in copending application U.S. Ser. No. 262,097, filed May 11, 1981 and assigned to the present assignee, which defines an electroluminescent device having a dark field layer comprising a cermet of chromium oxide -chromium ($Cr_2O_3/Cr$). Although overcoming the toxicity problem, this cermet comprises a combination of a metal (Cr) and an oxide ($Cr_2O_3$) of the same base metal, thereby rendering the dark field composition difficult, if not impossible, for analysis of the constituent proportions. Such analysis is important to enable precise control of the constituent proportion for providing optimum results.

Accordingly, it is an object of the present invention to provide an improved electroluminescent display device and in particular an improved dark field material for such a device.

A further object of the present invention is to provide an improved dark field in accordance with the preceding object and which is characterized by an enhanced brightness of the phosphor carried out by temperature control which has been found to be a function of the composition of the dark field layer.

Another object of the present invention is to provide an improved dark field in accordance with the preceding objects and which is characterized by an improved contrast ratio of the device.

Still another object of the present invention is to provide a dark field material in accordance with the preceding objects and which is non-toxic and meets the safety specifications for commercial products required by OSHA.

A further object of the present invention is to provide an improved dark field layer in a thin film electroluminescent display device in which for at least some applications, only a single transparent dielectric layer of the device is employed in comparison with the typical first and second transparent dielectric layers used in the past in electroluminescent thin film display devices.

Still a further object of the present invention is to provide an improved dark field material for a thin film electroluminescent display device in which the dark field layer is formed of constituents which are readily analyzable, and thus precisely controllable, to provide enhanced flexibility in controlling parameters of the dark field layer such as contrast ratio.

SUMMARY OF THE INVENTION

To accomplish the foregoing and other objects and advantages of the present invention, there is provided an improved dark field material for a thin film electroluminescent display device, which display device typically comprises an electroluminescent phosphor layer disposed between two electrode layers with one of the electrodes being transparent to permit viewability of the phosphor layer. The improved dark field layer in accordance with the present invention comprises a composition of a dielectric material, preferably a ceramic, in combination with a noble metal, which in the preferred embodiment is gold. The ceramic is preferably magnesium oxide. The preferred composition of magnesium oxide and gold may be formed by a sputtering technique, examples of which are described in further detail hereinafter. It has been found in accordance with the present invention that the brightness of the electroluminescent phosphor is a function of the temperature of the display, and the temperature, in turn, is controlled in accordance with the invention by the concentration of noble metal, or in the preferred embodiment, a concentration of gold. Opacity of the dark field layer is controlled in like manner. Both of these parameters enhance contrast ratio. The preferred percentage range of the gold concentration has been found to be in the range of 6%–10% by volume. It has been found that a concentration below 6% does not provide a sufficient contrast ratio because the opacity of the dark field layer is too low. However, beyond 10% of the noble metal by volume, there is an undesirably excessive conductivity with attendant breakdown of the phosphor layer and improper operation.

BRIEF DESCRIPTION OF THE DRAWINGS

Numerous other objects, features and advantages of the invention should now become apparent upon a reading of the following detailed description taken in conjunction with the accompanying drawing, in which.

DESCRIPTION OF THE PREFERRED EMBODIMENT

In co-pending application Ser. No. 540,223 filed of even date herewith and assigned to the present assignee, there is described a dark field material that is non-toxic and safe to use in the construction of thin film electroluminescent display devices. This material is in the form of a composition of a dielectric material with a noble metal. The dark field layer serves the basic purpose of enhancing the contrast between the displayed information which is usually in segment form and the background. In order to eliminate the prior art problem associated with CdTe dark field layers, which are toxic, it has been found that a composition of, for example, magnesium oxide and gold which are co-evaporated, preferably by an electron beam technique, provide a dark field material that is non-toxic, is readily analyzable and meets the safety specifications for commercial products. A layer of such material has not previously been employed at all in the construction of electroluminescent display devices, although, a MgO/Au film has been previously evaluated as a solar absorbing material for solar panels. In this regard see U.S. Pat. No. 4,312,915; also, see the article by Fan and Zavracky, Applied Physics Letters, Volume 29, No. 8, Oct. 15, 1976, page 478–480. Also see the article by Berthier and Lafait in Thin Solid Films 89 (1982) 213–220 entitled "Optical Properties of Au-MgO Cermet Thin Films: Percerlation Threshold and Grain Size Effect". The latter article is concerned primarily with the method of deposition and associated optical properties.

Figure 1:
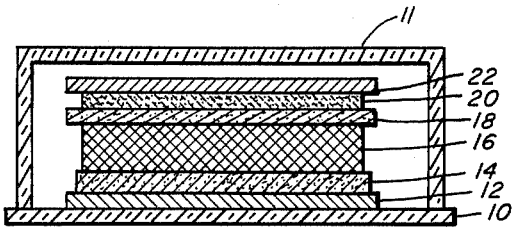
FIG. 1 is a schematic cross-sectional view showing the multiple layers of a thin film electroluminescent display device including the dark field layer of this invention.
Figure 2:
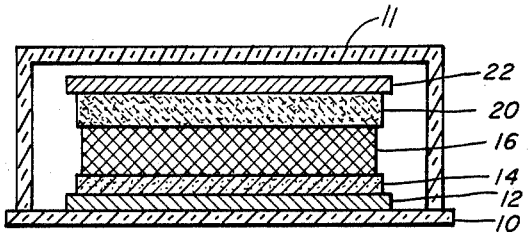
FIG. 2 is a schematic cross-sectional view showing an alternate construction of the thin film electroluminescent display device showing a single transparent dielectric layer rather than the two dielectric layers depicted in FIG. 1.

With reference to the drawing, it is noted that in FIG. 1 there is shown a version of an electroluminescent display device incorporating the dark field of this invention. In FIG. 2, one of the two transparent dielectric layers shown in FIG. 1 has been removed because the improved dark field layer also functions as a substitute for one of the dielectric layers. In other words the dielectric/noble metal composition serves both as the dark field and as the second dielectric.

In FIGS. 1 and 2, like reference characters are used to identify like layers of each embodiment disclosed. Thus, there is shown a glass substrate 10 on which are formed a number of multiple thin-film layers which may be enclosed by a glass seal 11. These layers include a transparent electrode 12, a first transparent dielectric layer 14, an electroluminescent phosphor layer 16, a second transparent dielectric layer 18, a dark field layer 20, and a back segmented electrode 22. In FIGS. 1 and 2 the transparent dielectric layers may be of yttria, and the electroluminescent phosphor layer may be of, for example, zinc sulphide. In the embodiment of FIG. 1, the second dielectric layer 18 is shown, but it is noted that in the embodiment of FIG. 2 this layer is not present. The dark field layer 20 in FIG. 2 instead serves both as the dark field and as the second dielectric layer.

The composition of the dark field layer 20, which in its broadest sense comprises a dielectric material, preferably a ceramic, and a noble metal, preferably gold, may be deposited by co-evaporation using standard deposition techniques. In accordance with one technique, co-evaporation is used with e-beam equipment. The evaporation may take place in one chamber of a two-chamber system. The two chamber system has two e-beam guns, each with its own power supply. In the preferred version, magnesium oxide may be in pellet form and loaded into one crucible, and gold is disposed in the second crucible. The deposition may be measured by means of conventional crystal monitors. One crystal monitor is placed over each crucible being disposed as close as possible to the position where the substrate is. The co-evaporation technique using separate crucibles is carried out in a vacuum of preferably better than $1\times10^{-5}$ torr. In accordance with the present invention, the volume percentage of gold is varied with the gold concentration preferably in the range of 6%–10% by volume. The percentage of gold in the composition controls the resistivity of the cermet.

In one test that was carried out, the dark field layer had a thickness of 0.5 micron. The preferred film thickness is in the range of 5000–9000 Angstroms. The lateral resistance between back electrode segments is on the order of 10 megohms while the perpendicular resistance across the film thickness is on the order of 1K ohm or less. A contrast ratio of 2:1 is measured at an ambient light level of 2500 foot-candles with the back electrode segments at 160 volts and 60 foot-lamberts. With those parameters, display devices have been operated successfully up to 500 hours of operating time.

With regard to measurements of contrast between the displayed information and the background, such measurements have been taken by shining a Sylvania Sun-Gun lamp at the lighted and unlighted display segments. The Sun-Gun lamp was set at an output of 3500 foot-candles. In two different respective devices that were tested, the contrast ratio measured was 4.2 and 5.3, respectively.

In accordance with another technique for forming the dark field layer, sputtering may be used in a reactive atmosphere of say argon and oxygen in a ratio of 70%–30%, respectively.

One of the primary advantages of the composition MgO/Au is that the material itself as well as the process forming it is non-toxic. Also, the admixed metal (Au) and the metal of the metal oxide (Mg) are two different materials and thus the ratio between these constituents is readily analyzable and, thus, provides for an added degree of control over such parameters of the dark field layer as electrical conductivity and optical absorption.

Reference has been made to the preferred layer construction of magnesium oxide and gold. However, it is understood that in accordance with other embodiments of the invention the composition may comprise other noble metals in place of the gold such as platinum or silver. The dielectric portion of the composition may be a ceramic. This can be a metal oxide or a metal nitride (such as aluminum nitride) or can even be a semiconductor such as silicon dioxide or germanium dioxide. The noble metal portion of the composition is in the form of a relatively stable metal thus not tending to react with the metallic in the ceramic portion of the composition. The noble metal, such a gold, does not readily oxidize if it is mixed with the magnesium oxide.

In the aforementioned description of the overall dark field layer, the percentage by volume of the noble metal controls the resistivity of the dark field layer. I have further discovered that the percentage by volume of the noble metal also controls the opacity and, thus, the radiation absorption of the dark field layer, which in turn affects the dark field layer operating temperature and also the temperature of the overall display device including the electroluminescent phosphor layer. An increase in opacity of the dark field layer provides an increase in the contrast ratio of the display device, thereby enhancing visibility of illuminated segments in high ambient light levels. Further, the brightness of the phosphor layer is a function of the temperature display, and, of course, increased brightness also contributes to an increase in the contrast ratio. Both of these parameters, i.e., opacity and temperature, can be controlled by controlling the concentration of the noble metal. The temperature effect is explained by the increased absorption of radiation not only from the visible part of the spectrum but also from the near infra-red. In the preferred embodiment of the invention, where gold is used as the noble metal, this involves the control of the concentration of the gold part of the composition. In accordance with the present invention, the preferred range of noble metal is 6%-10%. If there is substantially less than 6% gold by volume, then there is not a sufficient contrast ratio since the opacity of the dark field layer is too low. There is simply not enough gold in the dielectric layer. As more gold is used, the resistivity of the dark field layer decreases, i.e., conductivity is increased. Further, the increased proportion of gold provides an increase in the opacity of the dark field layer and an increase in the operating temperature of the display, thereby enhancing the contrast ratio. Beyond about 10% of gold by volume, however, an undesired excess conductivity results causing a breakdown and possibly a destruction of the phosphor layer. In this latter case, the device does not operate properly, and there is apt to be illumination in areas other than where segments occur, due to a breakdown through the phosphor layer between electrodes.

Two operable devices with dark fields containing 7.5% and 9.5% by volume of gold have been life tested. Both devices, along with one control device which had no dark field, have been operated under identical ambient temperature conditions for hundreds of hours. The operating temperature of the sample with 7.5% by volume of gold was 41° C. while the more absorbing sample with 9.5% by volume of gold operated at 54° C. There was thus a 13° C. increase in temperature accompanied by an attendant increase in illumination. The control device had at the same time, a temperature of 31° C. The ambient temperature during these tests was 25° C.

When the ambient temperature was lowered to 16° C., the corresponding operating temperatures of the three devices were:

7.5% gold by volume—33° C.
9.5% gold by volume—47° C.
Control device—25° C.

From the above it is readily seen that by varying the gold (or other noble metal) content in the MgO/Au cermet used as the dark field layer, one can control the operating temperature of the electroluminescent display device either up or down, depending upon the conditions under which the device has to function.

Having now described a limited number of embodiments of the present invention, it should now be apparent to those skilled in the art that numerous other embodiments are contemplated as falling within the scope of this invention as defined by the appended claims.

What is claimed is:

1. An electroluminescent display device comprising a transparent electrode layer, a segmented electrode layer, an electroluminescent phosphor layer disposed between said electrode layers, and a dark field layer of a composition of a dielectric material with a noble metal, wherein the percentage of noble metal by volume is in the range of 6%-10%, said dark field layer being interposed between said electroluminescent phosphor layer and said segmented electrode layer, said dark field layer having a film thickness in the range of about 5,000 to about 9,000 Angstroms, said noble metal controlling the opacity and operating temperature of said dark field layer.

2. An electroluminescent display device as set forth in claim 1 including only a single transparent dielectric layer adjacent the electroluminescent phosphor layer.

3. An electroluminescent display device as set forth in claim 1 wherein the device has a contrast ratio of at least 2:1.

4. An electroluminescent display device as set forth in claim 1 wherein the composition of the dark field layer is deposited by co-evaporation from separate sources.

5. An electroluminescent display device as set forth in claim 1 wherein the noble metal comprises gold.

6. An electroluminescent display device as set forth in claim 1 wherein said dielectric material of the dark field layer comprises a metal oxide.

7. An electroluminescent display device as set forth in claim 6 wherein said metal oxide comprises magnesium oxide.

8. An electroluminescent display device as set forth in claim 1 wherein said dielectric material of the dark field layer comprises silicon dioxide.

9. An electroluminescent display device as set forth in claim 1 wherein said dielectric material of the dark field layer comprises germanium dioxide.

10. An electroluminescent display device as set forth in claim 1 wherein said dielectric material of the dark field layer comprises aluminum nitride.

11. An electroluminescent display device as set forth in claim 1 wherein said dielectric material is comprised of a metal oxide, a metal nitride or a semiconductor.

* * * * *